United States Patent [19]

Zetlmeisl et al.

[11] Patent Number: 4,941,994

[45] Date of Patent: Jul. 17, 1990

[54] CORROSION INHIBITORS FOR USE IN HOT HYDROCARBONS

[75] Inventors: Michael J. Zetlmeisl; Benjamin T. Outlaw, both of St. Louis, Mo.

[73] Assignee: Petrolite Corporation, St. Louis, Mo.

[21] Appl. No.: 381,549

[22] Filed: Jul. 18, 1989

[51] Int. Cl.[5] ..... C23F 11/10

[52] U.S. Cl. ..... 252/389.23; 252/389.24; 252/391

[58] Field of Search ..... 252/391, 389.22, 389.23, 252/389.24

[56] References Cited

U.S. PATENT DOCUMENTS

| | | | |
|---|---|---|---|
| 4,446,056 | 1/1984 | Thompson | 252/391 |
| 4,514,320 | 4/1985 | Ouinlan | 252/391 |
| 4,525,296 | 6/1985 | Ouinlan | 252/391 |
| 4,842,716 | 6/1989 | Kaplan et al. | 252/389.24 X |

OTHER PUBLICATIONS

Derwent Classes M13 P42, Sep. 4, 1981, Abstract No. J56112479A.

Derwent Classes A97, H07M14, Oct. 12, 1985, Abstract No. J60202197.

Japan Abstracts, vol. 11, Section No. 436, Sec. C, No. 229, p. 91, "Metal Processing Oil Composition".

*Primary Examiner*—John S. Maples

*Assistant Examiner*—Valerie D. Fee

*Attorney, Agent, or Firm*—Stanley M. Tarter

[57] ABSTRACT

Corrosion of metal surfaces in contact with a hot hydrocarbon stock containing an appreciable amount of naphthenic acid is inhibited by the presence in the hydrocarbon stock of an effective corrosion inhibiting amount of a dialkyl or trialkyl phosphite, alone or together with a thiazoline.

5 Claims, No Drawings

CORROSION INHIBITORS FOR USE IN HOT HYDROCARBONS

BACKGROUND OF THE INVENTION

The present invention relates to the inhibition of metal corrosion in acidic hot hydrocarbons. More particularly, the present invention relates to the inhibition of corrosion of iron-containing metals in hot acidic hydrocarbons, especially when the acidity is derived from the presence of naphthenic acid.

DESCRIPTION OF THE PRIOR ART

In the processing of crude oil in a refinery, it has been known for several decades that crudes with acid numbers (mg KOH/gm oil) greater than 0.5 have been found to be extremely corrosive to furnace tubes, transfer lines, trays and certain side cuts of the atmospheric units and especially of the vacuum units. The corrosive problem is known to be aggravated by the elevated temperatures necessary to refine and crack the oil and by the oil's acidity which is caused primarily by high levels of naphthenic acid indigenous to the crudes. Sulfur in the crudes which produces hydrogen sulfide at higher temperatures also aggravates the problem. The temperature range of primary interest for this type of corrosion is in the range of about 175° to 400° C. Up to the present, there has been very little success with chemical inhibition of this type of corrosion. Instead, most refineries which process high acid crudes are protected by metallurgical changes. Even the advanced materials, however, are not without their problems.

Many different types of inhibitors have been proposed, but there has been a continuing search for inhibitors which can be used effectively in small concentrations and which are economical to produce. There exists a special need for such types of inhibitors which are effective at elevated temperatures of about 175° C. and higher, such as the temperature used in refining crude oil.

In U.S. Pat. No. 4,443,609, certain tetrahydrothiazole phosphonic acids and esters are disclosed as being useful as acid corrosion inhibitors. Such inhibitors can be prepared by reacting certain 2,5-dihydrothiazoles with a dialkyl phosphite. While these tetrahydrothiazole phosphonic acids or esters have good corrosion inhibition properties, they tend to break down during high temperature applications thereof with possible emission of obnoxious and toxic substances.

SUMMARY OF THE INVENTION

In accordance with the present invention, metal corrosion in hot acidic liquid hydrocarbons is inhibited by the presence of a corrosion inhibiting amount of a dialkyl phosphite or trialkyl phosphite having the respective structural formulas:

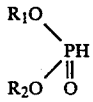

(I)

or

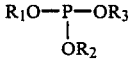

(II)

wherein $R_1$, $R_2$, and $R_3$ are each independently a straight or branched chain lower alkyl radical, especially an alkyl radical having 1 to 10 carbon atoms. Such metal corrosion inhibition can be made further effective when the abovedescribed dialkyl phosphites and/or trialkyl phosphites are used together with a thiazoline having the structural formula:

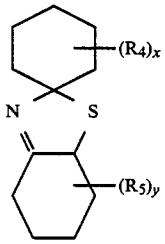

wherein $R_4$ and $R_5$ are each independently $C_1$–$C_{10}$ alkyls and x and y are each integers of 0 to 4. Other substituents may be made on either of the six membered rings, as long as the efficacy of the corrosion inhibition of the thiazoline is not significantly adversely affected. It has also been found that the above-described thiazolines are themselves excellent corrosion inhibitors. It is preferred to use the dialkyl or trialkyl phosphites and the thiazolines together as a mixture. When used alone, the phosphites provide greater corrosion inhibition than the thiazolines alone provide. In order to provide effective corrosion control while taking advantage of the lower cost for producing the thiazolines, a mixture of the two inhibitors provides the best overall balance of economics and corrosion control. While the amount of phosphite to thiazoline on a weight ratio basis may range from 0:100 to 100:0, it is preferred that the ratio be in the range of about 10:90 to 90:10. More preferably, the weight ratio of phosphite to thiazoline is in the range of about 20:80 to 80:20.

DETAILED DESCRIPTION OF THE INVENTION

A method is provided for inhibiting the corrosion of metals, especially iron-containing metals, by incorporating into a liquid hydrocarbon in contact with the metal an effective amount of a dialkyl and/or a trialkyl phosphite having the respective structural formulas:

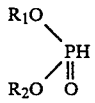

(I)

or

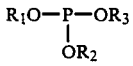

(II)

In the formulas, $R_1$, $R_2$, and $R_3$ each independently represent a lower alkyl radical which may have a straight or branched chain. The number of carbon atoms in the lower alkyl radicals may range from 1 to about 10 with the preferred range being from 1 to about 6, and/or a thiazoline having the structural formula:

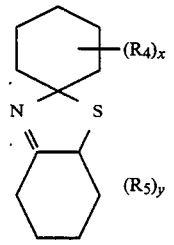

wherein $R_4$ and $R_5$ are each independently $C_1$–$C_{10}$ alkyls (preferably $C_1$–$C_5$ alkyls) and x and y are each independent integers of 0 to 4 inclusive. While it is preferred that the six membered rings of the thiazoline have no substituent, it will be recognized by one skilled in the art that other substituents may be present on the six membered rings as long as the efficacy of the corrosion inhibition of the thiazolines is not unduly affected.

The corrosion inhibiting activity of the abovedescribed dialkyl and trialkyl phosphites and/or the abovedescribed thiazolines are especially useful in liquid hydrocarbons and petrochemicals during the processing thereof where the process temperature is elevated to 35°–540° C. or higher. The additives are especially useful at process temperatures of about 100°–440° C. or higher and particularly where the liquid is acidic and more particularly where the acidity is due at least in part by the presence therein of corrosion inducing amounts of naphthenic acid or other similar organic acids.

As commonly used, naphthenic acid is a collective term for certain organic acids present in various crude oils. Although there may be present minor amounts of other organic acids, it is understood that the majority of the acids in a naphthenic base crudes are naphthenic in character, i.e., with a saturated ring structure as follows:

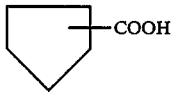

The molecular weight of the naphthenic acid can extend over a large range. However, the majority of the naphthenic acid from crude oils is found in gas oil and light lubricating oil fractions. When hydrocarbons containing such naphthenic acid are in contact with iron-containing metals, especially at elevated temperatures, severe corrosion problems arise. Such problems are ameliorated by incorporating the dialkyl or trialkyl phosphite additive and/or the thiazoline additive in an effective amount in such hydrocarbons.

The most effective amount of the corrosion inhibitor or mixture of inhibitors to be used in accordance with this invention can vary, depending on the local operating conditions and the particular hydrocarbon being processed. Thus, the temperature and other characteristics of the acid corrosion system can have a bearing on the amount of the inhibitor or mixture of inhibitors to be used. Generally, where the operating temperatures and/or the acid concentrations are higher, a proportionately higher amount of the corrosion inhibitor will be required. It has been found that the concentration of the corrosion inhibitors or mixture of inhibitors may range from about 5 ppm to 5000 ppm or higher. It has also been found that it is preferred to add the inhibitors at a relatively high initial dosage rate of 2000–3000 ppm and to maintain this level for a relatively short period of time until the presence of the inhibitor induces the build-up of a corrosion protective coating on the metal surfaces. Once the protective surface is established, the dosage rate needed to maintain the protection may be reduced to a normal operational range of about 100 ppm without substantial sacrifice of protection.

While the gas oil and light lubricating oil fractions often contain naphthenic acid which contributes to the corrosion problem which the present invention especially relieves, the anticorrosion additives are not only useful in inhibiting corrosion in the part of a refinery handling these petroleum intermediates but are useful throughout an oil refinery where acidic hydrocarbons are in contact with an iron-containing metal. Furthermore, corrosion problems can be solved in petrochemical processes when an acidic organic liquid is in contact with a metal.

The invention will now be further disclosed in the following illustrative examples, wherein parts and percentages are given on a weight basis unless otherwise specified.

EXAMPLE 1

This example illustrates the preparation of 2,2-pentamethylene-4,5-tetramethylene-1,3-thiazoline.

Two moles of cyclohexanone and one mole of sulfur (elemental) were added to a reactor containing a xylene based solvent (Solvent 14). Ammonia gas was sparged through the resulting mixture. The sparging was continued for two hours. The reaction was exothermic. During the sparging the temperature was controlled for a maximum of 50° C. The pressure in the reactor during sparging was maintained at 40 psig (3.8 kg/cm$^2$). After completion of the reaction the mixture was removed from the reactor; and the water of reaction was removed from the mixture by distillation. The reaction product was identified by analysis to be 2,2-pentamethylene-4,5-tetramethylene-1,3-thiazoline with a product yield of about 75%.

EXAMPLE 2

In this example, various amounts of diethyl phosphite (hereinafter DEP for purposes of brevity) and/or the thiazoline (hereinafter THI for purposes of brevity) prepared in accordance with Example 1 were tested for inhibiting corrosion of mild steel in a hot hydrocarbon containing naphthenic acid. The results of the tests have been summarized in the table below where corrosion rates (corrate) are given in terms of mils per year (MPY).

In each test a conventional corrosion testing procedure and apparatus were employed. A 500 ml resin pot was charged with 350 ml of a commercially available hydrocarbon stock. The stock had a boiling point range of 390° to 460° C. and was comprised of 75.1% aromatics, 18.9% polar compounds and 6.0% saturates. A heavy gas oil from a West Coast refinery and a commercially available high flash white oil (100%) aliphatic were also used as the hydrocarbon stock with similar results being obtained as was obtained in this example. The pot was provided with an internal stirring paddle and a heating mantle. The pot was equipped with a Claisen adaptor with a condenser in one arm and a sparge tube in the other arm. The hydrocarbon stock in the pot was gradually heated to 315° C. while being sparged with argon. The off gas was removed from the pot through the open end of the condenser. When the hydrocarbon stock attained a temperature of 315° C., the stock was sparged with argon gas containing 1% hydrogen sulfide gas for 30 minutes before insertion of the test coupons, acid, and inhibitors. The hydrogen sulfide gas was dissolved in the hydrocarbon stock so as to simulate the hydrogen sulfide content often found in the crude oil and intermediate refined products in an oil refinery. Thereafter, 35 ml of naphthenic acid, as described above, was added to the hydrocarbon to simulate a hydrocarbon stock having an appreciable amount of commercially available naphthenic acid having an acid number of 170. The corrosion inhibitor also was added at this point. After adding the ingredients to the pot, three test cylindrical mild steel coupons (¼" diameter by 3" length) (0.64 cm×7.6 cm) were mounted within the pot so as to be fully immersed in the hydrocarbon stock. Before insertion of the coupons, they were rinsed with acetone and weighed.

After twenty hours of being immersed in the hydrocarbon stock heated at 315° C., the coupons were removed from the apparatus and rinsed sequentially with xylene and acetone.

Thereafter, the test coupons were cleaned with a polishing cloth and cleanser plus water. Next, the coupons were rinsed thoroughly with water, then acetone and then dried in a desiccator before determining the weight loss of the coupons while having been immersed in the hot hydrocarbon stock containing dissolved hydrogen sulfide and naphthenic acid. Loss of metal due to corrosion in mils per year was calculated by the following equation:

$$MPY = \frac{\text{mg wt loss}}{(0.00228)\ (9)\ (\text{No. of hours})}$$

TABLE 1

| Test No. | DEP (ppm) | THI (ppm) | Corrate (MPY) |
|---|---|---|---|
| 1 | 0 | 0 | 141 |
| 2 | 0 | 1300 | 67 |
| 3 | 0 | 1300 | 57 |
| 4 | 0 | 702 | 77 |
| 5 | 0 | 702 | 69 |
| 6 | 320 | 393 | 22 |
| 7 | 320 | 393 | 57 |
| 8 | 325 | 533 | 9 |
| 9 | 325 | 533 | 5 |
| 10 | 325 | 533 | 9 |
| 11 | 325 | 533 | 6 |
| 12 | 510 | 785 | 4 |
| 13 | 510 | 785 | 5 |
| 14 | 517 | 471 | 7 |
| 15 | 517 | 471 | 7 |
| 16 | 517 | 471 | 15 |
| 17 | 517 | 471 | 7 |
| 18 | 517 | 471 | 13 |
| 19 | 517 | 471 | 7 |
| 20 | 517 | 471 | 8 |
| 21 | 517 | 315 | 10 |
| 22 | 517 | 315 | 7 |
| 23 | 517 | 315 | 17 |
| 24 | 650 | 354 | 24 |
| 25 | 650 | 354 | 14 |
| 26 | 650 | 354 | 28 |
| 27 | 978 | 177 | 12 |
| 28 | 978 | 177 | 2 |
| 29 | 1300 | 0 | 4 |
| 30 | 1300 | 0 | 5 |
| 31 | 523 | 494 | 13 |
| 32 | 523 | 510 | 11 |

TABLE 1-continued

| Test No. | DEP (ppm) | THI (ppm) | Corrate (MPY) |
|---|---|---|---|
| 33 | 523 | 517 | 12 |
| 34 | 523 | 559 | 10 |
| 35 | 523 | 603 | 10 |
| 36 | 653 | 216 | 21 |
| 37 | 653 | 216 | 34 |

As can be noted from the above table either DEP or THI alone or taken together as a mixture of anticorrosion additives provides excellent corrosion resistance where an iron-containing metal is in contact with a hot hydrocarbon stock containing naphthenic acid and hydrogen sulfide. When neither anticorrosion additive is employed, the average corrosion rate of about 25 of these blank runs was measured to be 141 MPY, the value given for Test 1. However, when 1300 ppm of THI is present in the same stock, the corrosion rate is reduced to about 60 MPY on average or by greater than 50%. When 1300 ppm of DEP is present in the same stock, the corrosion rate is reduced to about 4 MPY on average or by greater than 97%. Effective corrosion control is also obtained when both DEP and THI are employed together in various amounts.

EXAMPLE 3

In this example, the procedure of Example 2 was repeated except a different corrosion inhibiting additive was employed. Instead of using diethyl phosphite, dimethyl phosphite (DMP) and dibutyl phosphite (DBP) were tested as corrosion inhibitors. It was found that both DMP and DBP provided excellent corrosion inhibition in hydrocarbon stocks containing an appreciable amount of naphthenic acid. The data obtained from the tests of this example have been set forth in Table 2.

TABLE 2

| Test No. | DMP (ppm) | DBP (ppm) | THI (ppm) | Corrate (MPY) |
|---|---|---|---|---|
| 1 | 0 | 0 | 0 | 141 |
| 2 | 322 | 0 | 702 | 8.6 |
| 3 | 322 | 0 | 702 | 7.72 |
| 4 | 0 | 520 | 650 | 14.6 |
| 5 | 0 | 520 | 650 | 10.8 |

EXAMPLE 4

In this example, the procedure of Example 2 was repeated except a different corrosion inhibiting additive was employed. Instead of using diethyl phosphite, trimethyl phosphite (TMP) and tributyl phosphite (TBP) were tested as a corrosion inhibitor. It was found that both TMP and TBP provided excellent corrosion inhibition in hydrocarbon stocks containing an appreciable amount of naphthenic acid. The data obtained from the tests of this example have been set forth in Table 3.

TABLE 3

| Test No. | TMP (ppm) | TBP (ppm) | THI (ppm) | Corrate (MPY) |
|---|---|---|---|---|
| 1 | 0 | 0 | 0 | 141 |
| 2 | 356 | 0 | 676 | 7.31 |
| 3 | 356 | 0 | 676 | 20.4 |
| 4 | 0 | 624 | 598 | 28.7 |
| 5 | 0 | 624 | 598 | 48.7 |

EXAMPLE 5

In a field test at a large US West Coast refinery involving the use of a 1 to 2 mixture of DEP to THI, the treatment was commenced at a dosage rate of inhibitors of 1800 ppm. After two days of operation, the dosage rate of inhibitors was reduced so as to maintain a running dosage rate of 50–70 ppm for the remainder of the test period. It was found that the corrosion rate of the test coupons after a running period of 21days was less than 2 MPY as compared to a corrosion rate of 200 MPY for coupons in a similar stream containing no corrosion inhibitors.

While the illustrative embodiments of the invention have been described with particularity, it will be understood that various other modifications will be apparent to or can be readily made by those skilled in the art without departing from the spirit and scope of the invention. Accordingly, it is not intended that the scope of the claims appended hereto be limited to the examples and descriptions as set forth hereinabove, but rather that the claims be construed as encompassing all the features of patentable novelty which reside in the present invention, including all features which would be treated as equivalents thereof by those skilled in the art.

What is claimed is:

1. A process of inhibiting nonaqueous corrosion of iron-containing metal surfaces in crude oil refining and cracking apparatus in a crude oil containing a corrosive amount of napthenic acid undergoing refining and cracking comprising maintaining an effective corrosion inhibiting amount of a dialkyl phosphite or a trialkyl phosphite having the structural formula:

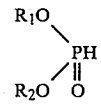

(I)

or

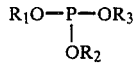

(II)

wherein $R_1$, $R_2$, and $R_3$ are each independently a straight or branched chain lower alkyl radical having 1 to 10 carbon atoms.

2. The process of claim 1 wherein $R_1$, $R_2$, and $R_3$ are each independently a straight or branched lower alkyl radical having 1 to 6 carbon atoms.

3. The process of claim 1 wherein the dialkyl phosphite is diethyl phosphite, dimethyl phosphite, or dibutyl phosphite and the trialkyl phosphite is trimethyl phosphite or tributyl phosphite.

4. The process of claim 1 wherein the corrosion inhibiting effectiveness of the phosphite is enhanced by the presence of a thiazoline having the chemical structure of:

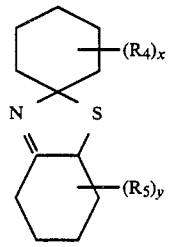

wherein $R_4$ and $R_5$ are each independently $C_1$–$C_{10}$ alkyls, and x and y are each integers of 0 to 4, inclusive.

5. The process of claim 4 wherein the thiazoline is 2,2-pentamethylene-4,5-tetramethylene-1,3-thiazoline.

* * * * *